US005863687A

United States Patent [19]

Mochizuki et al.

[11] Patent Number: 5,863,687

[45] Date of Patent: Jan. 26, 1999

[54] ELECTROPHOTOGRAPHIC PHOTORECEPTOR

[75] Inventors: Fumitaka Mochizuki; Eiichi Sakai; Masaru Sano, all of Tokyo, Japan

[73] Assignee: Konica Corporation, Japan

[21] Appl. No.: 741,384

[22] Filed: Oct. 29, 1996

[30] Foreign Application Priority Data

Nov. 2, 1995 [JP] Japan ..... 7-285878
Nov. 9, 1995 [JP] Japan ..... 7-291289

[51] Int. Cl.[6] ..... G03G 5/14

[52] U.S. Cl. ..... 430/63; 430/62; 430/64; 430/65; 430/131

[58] Field of Search ..... 430/64, 65, 131, 430/63, 62; 399/220, 159

[56] References Cited

U.S. PATENT DOCUMENTS

| | | | |
|---|---|---|---|
| 4,281,055 | 7/1981 | Moriguchi et al. . | |
| 4,282,294 | 8/1981 | Lee et al. | 430/64 |
| 4,464,450 | 8/1984 | Teuscher | 430/65 |
| 4,780,385 | 10/1988 | Wieloch et al. | 430/64 |
| 5,017,449 | 5/1991 | Yoshihara | 430/64 |
| 5,372,904 | 12/1994 | Yu et al. . | |
| 5,378,566 | 1/1995 | Yu | 430/64 |
| 5,432,033 | 7/1995 | Asanae et al. | 399/152 |

FOREIGN PATENT DOCUMENTS 2642189 1/1990 France .

OTHER PUBLICATIONS

Borsenberger, Paul M. and David S. Weiss. Organic Photoreceptors for Imaging Systems. New York: Marcel–Dekker, Inc. pp. 6–17, 1993.
EOP Search Report EP 96 11 7320 and Annex.
Database WPI Section Ch, Week 9438, Derwent 94–308111.
Patent Abstracts of Japan, vol. 12, No. 166, JP62279344.
Derwent 93–105177.
Patent Abstracts of Japan, Vo.. 12, No. 43 & JP62191854.

*Primary Examiner*—Christopher D. Rodee
*Attorney, Agent, or Firm*—Jordan B. Bierman; Bierman, Muserlian and Lucas

[57] ABSTRACT

Disclosed is an electrophotographic photoreceptor comprising an insulating support and provided thereon, a conductive layer, an intermediate layer and a photosensitive layer, wherein said conductive layer has a work function W (eV), said intermediate layer has an ionization potential Ip (eV) and a relationship between the work function W (eV) and the ionization potential Ip (eV) satisfies Formula 1:

$$Ip > W + 0.5. \qquad \text{Formula 1}$$

11 Claims, 5 Drawing Sheets

ELECTROPHOTOGRAPHIC PHOTORECEPTOR

FIELD OF THE INVENTION

The present invention relates to an electrophotographic photoreceptor used in copying machines or printer and an image forming apparatus and an image forming method using the same. In addition, the present invention relates to a cylindrical substrate for an electorphotographic photoreceptor, a method of manufacturing it, and an electrophotographic photoreceptor and an image forming apparatus using the same.

BACKGROUND OF THE INVENTION

Heretofore, as a photosensitive material for an electrophotographic photoreceptor, inorganic photoconductive material such as selenium, selenium alloys, zinc oxide and sulfurized cadmium have mainly been employed.

Recently, organic photosensitive materials which can be selected those suitable for its purpose such as high productivity, non-polluting and inexpensive cost and targeted performances have come to be used. Among them, a function-separation type photoreceotr which is a combination of a charge generating material and a charge transparting material can noticeably improve sensitivity which had been a shortcoming of photoreceptors using organic photoconductive materials. Therefore, it is specifically noted.

However, if the above-mentioned function-separation type high sensitivity photoreceptor is applied to a so-called Carlson process, the surface charge is reduced due to charge injecting from the conductive layer. Namely, together with reduction of charge property, charge maintaining property deteriorates. In addition, after repeated use, the above-mentioned properties tend to be further deteriorated. Accordingly, uneven density and fogging occur on the image. In the case of reversal development, background contamination occurs. Due to repeated using and using for a long time, the problems commonly becomes worse.

Therefore, in order to overcome the above-mentioned problems, various studies to provide a means wherein an intermediate layer is provided between a conductive layer and a photosensitive layer have heretofore been proposed. For example, an intermediate layer employing a nylon resin, a vinylacetic acid resin, a polyvinyl alcohol resin, a resin wherein aluminum oxide was dispersed and a resin wherein tin Oxide have been studied. In addition, recently, ceramic-containing intermediate layers using an organic metal compound and a silane coupling agent have also been developed.

However, even if the above-mentioned intermediate layer was adopted, when a combination with the conductive layer is not appropriate, due to initial and repeated use, reduction of conductivity, increase of dark decay rate and the occurrence of fogging after using for a long period were observed so that it was shown that solution of the problems is not sufficient.

In an electrophotographic image forming apparatus, a electrostatic image forming material which plays an important role in producing an electrostatic latent image and in a developing process (typically, an electrophotographic photoreceptor. Hereinafter, it may be referred to as a photoreceptor) is necessary. In a transferring process which transfers the prepared toner image onto plain paper, a transferring material or an intermediate transferring material is necessary.

In order to execute their function, the electrostatic image forming material, the transferring material or the intermediate transferring material must move in prescribed timing and at a prescribed speed while not changing the interval and pressure condition with chargers, exposure devices, developing devices, charge-eliminating device or the cleaning devices, which are located around them. For repeated use, when one cycle of an image forming process is completed, they must return to the initial position for the next image forming cycle. In order to carry out the series of movements smoothly, and in order to use expensive member such as the photoreceptor more effectively, in apparatus for a practical use, the photoreceptor (electrostatic latent image forming material), the transferring material and the intermediate transferring material are almost cylindrical (drum-shaped). As a substance used therefor, metal material such as aluminum is generally used.

On the other hand, plastic is considered to be a preferable material since it is light and its cost is inexpensive. However, it is not easy to manufacture electrostatic latent image forming cylinder with high accuracy and with high effectiveness in terms of industrial setting. The major factor was that a method to manufacture a 30–200 mm diameter cylindrical subtrate simply at high accuracy could not be discovered. Therefore, accuracy had to be maintained by cutting and abrading the surface thereof after manufacturing the cylindrical subtrate, resulting in reduction of producibility and at an increase of cost. In addition, there was another shortcoming in that it is weak to heat and most solvent. In addition to accuracy on the surface of the subtrate, deformation due to stress and aging has also become a problem.

However, in the case of the image forming apparatus constituted of image exposing from inside of the photoreceptor as detailed later, the cylindrical subtrate of electrostatic latent image forming material must be transparent against light for exposure. Therefore, metals cannot be used as a material for a subtrate.

In addition, it is necessary to provide a transparent layer having conductivity on a cylindrical substrate which is also an insulating material. As a typical technology to provide conductivity, a method to deposit or spatter metal such as aluminum or ITO (Indium tin oxide) or other metal oxides and a method to disperse powdered metal and metal oxide fine particles in a resin and cause it in an ink state for coating are employed. However, the former method results in deformation wherein dimensional accuracy of the cylindrical subtrate due to heat is lost and increase in cost, and the latter method results in an increase of the number of processes and modification of the production facility.

Accordingly, though an image forming method wherein an image is exposed to light from inside is excellent as an apparatus, it was actually difficult to be come into practice.

A first object of the present invention is to provide an excellent electrophotographic photoreceptor having no reduction of electrification property between the initial cycle and after repeated use, no reduction of charge maintaining property, no occurrence of fogging, and an image forming method and an apparatus using the same.

A second object is to provide a cylindrical subtrate for an image forming apparatus, having a conductive layer on its surface, which can be manufactured effectively in an industrial setting, which has high surface accuracy, overall strength and which has sufficiently high transparency as necessary and a method for manufacturing therefor and an electrophotographic photoreceptor and an image forming apparatus using the same.

SUMMARY OF THE INVENTION

An electrophotographic photoreceptor of the present invention is an electrophotographic photoreceptor having an insulating support and provided thereon, a conductive layer, an intermediate layer and a photosensitive layer, wherein the relationship between the work function W(eV) of the conductive layer and the ionization potential Ip of the intermediate layer satisfies the following Formula 1 .

$$Ip>W+0.5(eV) \quad \text{Formula (1)}$$

The above-mentioned image forming apparatus of the present invention employs an electrophotographic photoreceptor mentioned above, and contains a uniform charging means, an image exposure means, a developing means, an image transfer means onto a recording medium, a recording medium separation means from a photoreceptor, a fixing means of the transferred image and a photoreceptor cleaning means.

The present invention employs the above-mentioned electrophotographic photoreceptor, and image forming is carried out through a uniform charging process, an image exposure process, a developing process, an image transfer process onto a recording medium, a recording medium separation process from a photoreceptor, a fixing process of the transferred image and a photoreceptor cleaning process.

The electrophotographic photoreceptor of the present invention contains a cylindrical subtrate.

Aforesaid cylindrical subtrate is preferably one wherein conductive ink in which conductive fine particles and a resin are mixed in a solvent was injected in a cylindrical mold, and after forming a coating layer by applying rotation and heating, polymerizable liquid material was injected for polymerization by applying rotation, heating or light again.

It is preferable that the surface resistivity value of the above-mentioned coated layer is not more than $10^8$ Ω/square.

One of the embodiments of the present invention is that the above-mentioned polymerizable liquid material is composed of a light-hardenable resin and that polymerization is conducted by irradiating UV rays when rotating again. In the present invention, UV ray has a wave length of 200 nm to 400 nm.

It is preferable that the above-mentioned polymerizable liquid material is transparent and that the light transmission rate of the coated layer at light wavelength of 500–800 nm is not less than 50%.

It is also preferable that the electrophotographic photoreceptor of the present invention and, around it, at least an electrification device and a developing device for plural color image formation are located and that an exposure device is located inside a cylindrical subtrate of photoreceptor.

BRIEF DESCRIPTION OF THE DRAWINGS

FIG. 5(*b*) is a cross sectional view of an example mold used in the photoreceptor manufacturing process according to the instant invention.

DETAILED DESCRIPTION OF THE INVENTION

Figure 1:
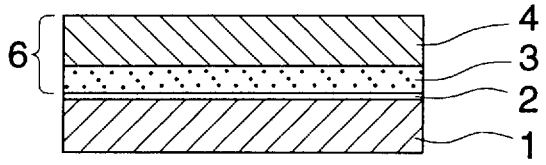
FIGS. 1(*a*) and 1(*b*) are cross sectional views of the layer structures of photoreceptors of the present invention.
Figure 1:
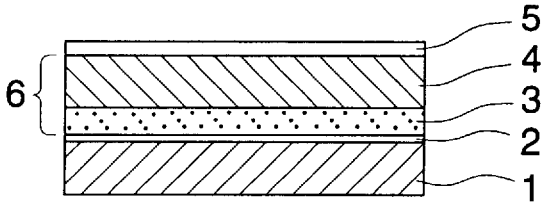

Hereinafter, the constitution of the present invention will be described in detail.

In order to obtain finished image with high quality, the photoreceptor must obtain sufficient charge potential and satisfy conditions such as that decay (dark decay) of the electrification potential is small.

One of the reasons to provide the intermediate layer is that, when a charge generating layer is directly coated on a conductive layer, injection of charge from the conductive layer is prevented so as to restrict the reduction of electrification potential. The ionization potential of the intermediate is ordinarily larger than that of the charge generating layer is selected. By increasing electrical barrier between the conductive layer and the intermediate layer compared with electrical barrier between the conductive layer and the charge generating layer, injection of charge is prevented.

However, it has not been clarified to what extent the electrical barrier between the conductive layer and the intermediate layer is sufficient as the electrical hindrance so that injection of charge from the conductive layer can be prevented. Specifically, if the conductive layer is formed on the insulating support and the photosensitive layer is formed thereon, the intermediate layer provided between the conductive layer and the photosensitive layer plays an important role for preventing injection of charge from the conductive layer.

The photoreceptor of the present invention comprises an insulating support provided thereon with a conductive layer, an intermediate layer and a photosensitive layer. Aforesaid conductive layer is a layer containing a conductive material on an insulating support.

As for an insulating support, conventional materials such as plastics including PET, poly(ethylene naphthalate), acrylic resins, drum-shaped material or sheet-shaped one including glass can be used.

In the present invention, the insulating support has a surface resistivity of not less than $10^{10}$ Ω/square.

As for a conductive layer, depositing or spattering of metal such as aluminum, tin oxide, ITO (indium tin oxide) or metal oxide or a conductive layer wherein tin oxide, ITO or a conductive polymer and a resin are mixed. This, materials other than these can be employed without specific limitation, provided that those can form a conductive layer.

As for an intermediate layer, it is preferable to use a resin-based intermediate layer using a polyamide resin such as nylon or a ceramic-containing intermediate layer using an organic metal compound and a silane coupling agent.

In the present invention, a polyamide resin used as a component for a subbing layer is, for example, various copolymer nylon as described in Japanese Patent Examined Publication No. 45707/1983. Specifically, for example, nylon 6/66, nylon 6/66/610 and nylon 6/66/610/12 are cited. The above-mentioned copolymer nylon can be obtained as a commercially available product. In addition, as another specified example, a N-alkoxymethyl modified nylon which homonylon is chemically modified, can be cited. As for aforesaid nylon, CM-8000 produced by Toray can be obtained as a commercially available product.

An intermediate layer (a subbing layer) preferably used in the present invention is a so-called hardenable type intermediate layer, in which an organic metal compound or a silane coupling agent or those produced therefrom are main components. It is diluted with a solvent for preparing a coating solution. The intermediate layer is formed by coating, drying and hardening.

A hardenable type intermediate layer (a subbing layer) contains an organic metal compound or a silane coupling agent or those produce therefrom as main components. It is preferable that 100% is the reaction product. However, a case when raw materials of the above-mentioned reaction product and other component are contained is also contained in the present invention.

As for an organic metal compound, metal alkoxide and metal chelate compounds are cited. Metals ordinarily include titanium, zirconium and aluminum.

As for the above-mentioned metal alkoxide, tetrapropoxy titanium, tetrabuthoxy titanium, tetrapropoxy aluminum and tetrabuthoxy zirconium are cited.

The above-mentioned metal chelate compounds include numerous kinds. As for a chelate group, (1) β-diketone such as acetylacetone and 2,4-heptanedione (2) Ketoester such as methyl acetoacetate, ethyl acetoacetate, propyl acetoacetate and butyl acetoacetate (3) Hydroxycarboxylic acid such as lactic acid, salicylic acid. and malic acid (4) Hydroxycarboxylic acid ester such as methyl lactate, ethyl lactate, ethyl salicylate and ethyl malate (5) Glycol such as octanediol and hexanediol (6) Ketoalcohol such as 4-hydroxy-4-methyl-2-pentanone (7) Aminoalcohol such as triethanolamine are cited. As a compound thereof, diisopropoxy titanium bis(acetylacetate) diisopropoxy aluminum bis(acetylacetate) buthoxy zirconium tri (acetylacetate) diisopropoxy titanium bis (ethylacetolacetate) diisopropoxy aluminum bis (ethylacetolacetate) diisopropoxy titanium bis (lactate) dibuthoxy titanium bis(octylene glycolate) diisopropoxy titanium bis(triethanolaminate)

are exemplified.

Of these, compounds having β-diketone and ketoester chelate group exhibit favorable potential properties and image properties. Specifically, compounds comprising both a chelate group and an alkoxy group are preferable.

As for an organic metal compound, a compound having the following structure is preferably employed.

$$(RO)_m MX_n$$

wherein R represents an alkyl group; M represents titanium, zirconium or aluminum; X represents a chelate forming group, including acetoacetic acid ester or a β diketone residual group; and m and n represent integers of 1 or more, provided that m+n is 4 when M is titanium or zirconium and m+n is 3 when M is aluminum.

Titanium and aluminum has excellent stability in terms of a coating solution. Therefore, they are specifically preferable.

As for a silane coupling agent, compounds having the following structure are preferable.

$$(Z)_a(A)_b Si(Y)_c$$

wherein Z represents a hydrolyzing group (for example, an alkoxy group, a halogen atom or an amino group); A represents an alkyl group or an aryl group; Y represents an organic functional group; a and c represent integers of no less than 1; b represents an integer of not less than 0; a+b+c=4; the kind of end group of organic functional group Y which influences the character thereof include γ-methacryloxy group γ-amino group N-phenyl-γ-amino group N-β(aminoethyl)γ-amino group γ-glycidoxy group β-(3,4epoxycyclohexyl) group γ-chloro group γ-mercapto group and, as compounds γ-aminopropyltrimethoxy silane N-β(aminoethyl)γ-aminopropyltrimethoxy silane N-phenyl-γ-aminopropyltrimethoxy silane γ-methacryloxy propyltrimethoxy silane γ-glycidoxy propyl methoxy silane β-(3,4epoxycyclohexyl)trimethoxy silane γ-chloropropyltrimethoxy silane γ-mercaptopropyl trimethoxy silane are cited; and of these, compounds having an organic functional group wherein it has a γ-methacryloxy group, a γ-amino group, an N-phenyl-γ-amino group at the end exhibit favorable properties in terms of potential properties and image properties.

Those which are preferable as silane coupling agents are those wherein organic functional group Y is BOOC(R')C=$CH_2$, BNHR" or —$BNH_2$; R' represents an alkyl group; R" represents an alkyl group or an aryl group; and B represents an alkylene group or an alkylene group containing —O—, —NH— or —CO—.

These organic metal compounds and silane coupling agents mentioned-above are respectively only one example. The present invention is not limited thereto.

The intermediate layer is preferably contains those made of an organic metal compound and a silane coupling agent. In this occasion, it exhibits specifically excellent potential properties and image properties.

The intermediate layer includes the above-mentioned organic metal compounds, silane coupling agent or those formed therefrom. As necessary, the above-mentioned intermediate layer may be formed by only the above-mentioned compounds, or as necessary, other compounds as a resin may be added in necessary amounts.

The intermediate layer coats the constitution material of the intermediate layer i.e., a solution (in the above, it was referred to as a coating solution) wherein an organic metal compound and a silane coupling agent were dissolved in a solvent on a conductive layer, dried and hardened for forming. As aforesaid solvent, for example, alcohols such as methanol, ethanol, propanol and buthanol, aromatic hydrocarbons such as toluene and esters such as ethylacetate and cellosolve acetate are cited. However, the present invention is not limited thereto. The above-mentioned compounds may be used singly or in combination. In addition, as necessary, water may be added.

As for a coating method of the coating solution, a dipping coating method, a spray coating method, a blade coating method, a spinner coating method, a bead coating method or a curtain coating method can be used.

With regard to drying conditions of the coating layer, drying temperature is 10°–250° C., and preferably 90°–200°

C. Drying time is 5 minutes to 5 hours, and preferably 20 minutes to 2 hours. Air blowing drying or static drying can be employed as drying method.

Work function W(eV) of the conductive layer and ionization potential Ip (eV) of the intermediate layer can be measured by the use of a low energy electron spectrometer AC-1, produced by Riken Keisokuki Co., Ltd. Ionization potential (Ip) and work function W(eV) are mainly dependent upon the material used. They can be adjusted about ±0.1 eV depending upon drying conditions and dispersing conditions.

Hereafter, the work function of the present invention and the ionization potential of the present invention are respectively explained in detail as follows.

<Work function of the conductive layer>

The work function denotes minimum energy necessary for taking out one electron from metal or the crystal surface of semi-conductor to just outside of the surface.

In the present invention, the metal or the semiconductor is contained in a conductive layer formed on an insulating support, and the conductive layer can be obtained by depositing such as aluminum, copper, gold, silver, platinum, paradium or ITO (indium—tin oxide) and metal oxide, or by dispersing conductive metal oxide (for example, ITO and $SnO_2$) for coating or by coating a conductive polymer such as polypyrrole.

In the present invention, metals and metal oxides having the following work function are preferably employed. Aluminum: 3.89, copper: 4.46, Gold: 4.42, Silver: 4.48, Platinum: 5.30, Palladium: 4.91 and ITO: 4.74

<Ionization potential of the intermediate layer>

In the present invention, the ionization potential of the intermediate layer denotes energy necessary for infinitely separating one electron from an atom or a molecule under base status in air for dissociating a positive ion and a free electron.

Both of the conductive layer and the intermediate layer are measured by a low energy electron spectral device (AC-1, produced by Riken Keiki). As for the conductive layer, "Work function W" is used, and as for the intermediate layer, "Ionization potential Ip" is used.

Furthermore, in the present invention, it is preferable that the relationship between the work function W (eV) and the ionization potential Ip (eV) satisfies Formula 2, provided that said work function W (ev) satisfies Formula 3:

$$7>Ip>W+0.5, \quad \text{Formula 2}$$

$$3.5<W<6.0. \quad \text{Formula 3}$$

And more preferably, the relationship satisfies Formula 4:

$$7>Ip>W+0.7. \quad \text{Formula 4}$$

In the present invention, it is preferable that the photosensitive layer is an organic photoreceptor containing an organic charge generating material (CGM) and a charge transporting material (CTM). FIG. 1 shows an example of a layer structure of aforesaid organic photoreceptor.

FIG. 1 shows a photoreceptor contains photosensitive layer 6 wherein charge generating layer (CGL) 3, charge transporting layer (CTL) 4 are coated through intermediate layer 2 onto a conductive support 1 in this order.

FIG. 1(*b*) shows a layer structure wherein protective layer 5 is laminated onto the photosensitive layer as shown in FIG. 1(*a*). The above-mentioned (a) and (b) show typical structure of the organic photoreceptor. However, the present invention is not limited thereto.

As for a charge generating material (CGM) contained in each of charge generating 3 shown in FIGS. 1(*a*) and 1(*b*), for example phthalocyanine pigments, polycyclic quinone pigments, azo pigments, perylene pigments, indigo pigments, quinacridone pigments, azulenium pigments, squalelium dyes, cyanine dyes, pyrilium dyes, thiopyrilium dyes, xanthene dyes, triphenylmethane dyes and styryl dyes are cited. The above-mentioned charge generating material (CGM) is used independently or together with a suitable binder resin for layer formation.

As a charge transporting material (CTM) contained in charge transporting layer 4, for example, oxazole derivatives, oxadiazole derivatives, thiazole derivatives, thiadiazole derivatives, triazole derivatives, imidazole derivatives, imidazolone derivatives, imidazoline derivatives, bisimidazolidine derivatives, styryl compounds, hydrazone compounds, benzidine compounds, pyrazoline derivatives, stilbene compounds, amine derivatives, oxazolone derivatives, benzothiazole derivatives, benzimidazole derivatives, quinazoline derivatives, benzofuran derivatives, acridine derivatives, phenazine derivatives, aminostilbene derivatives, poly-N-vinyl carbazole, poly-1-vinylpyrene and poly-9-vinyl anthracene are cited. The above-mentioned charge transporting material (CTM) is ordinarily used for layer formation together with a binder.

As a binder resin contained in the charge generating layer (CGL) and the charge transporting layer (CTL), polyester resins, polystyrene resin, methacrylic resin, acrylic resins, polyvinyl chloride resins, polyvinylidene resins, polycarbonate resins, polyvinyl butylal resins, polyvinyl acetate resins, styrene—butadiene resins, vinylidene chloride—acrylonitrile copolymer resins, vinyl chloride maleic acid anhydride copolymer resins, urethane resins, silicone resins, epoxy resins, silicone—alkyd resins, phenol resins, polysilane resins and polyvinyl carbazole are cited.

The binder resin contained in the uppermost layer of each photoreceptors in FIG. 1(*a*) and 1(*b*) are preferably strong against mechanical shock and has great anti-abrasion properties. Concurrently with this, it is also preferable not to hinder electrophotographic performance.

As examples of a solvent or a dispersion medium used for forming each of the above-mentioned layer, n-butylamin, diethylamine, ethylenediamine, isopropanolamine, triethanolamine, triethylenediamine, N,N-dimethylformamide, acetone, methyl ethyl ketone, methyl isopropyl ketone, cyclohexanone, benzene, toluene, xylene, chloroform, dichloromethane, 1,2-dichloroethane, 1,2-dichloropropane, 1,1,2-trichloroethane, 1,1,1-trichloroethane, trichloroethylene, tetrachloroethane, tetrahydrofuran, dioxane, methanol, ethanol, isopropanol, ethyl acetate, butyl acetate, dimethylsulfoxide and methylcellosolve are cited. Of these, when a ketone-containing solvent is used, sensitivity is improved, and potential change after repeated use also is reduced. The above-mentioned solvent may be used independently or, mixing solvent of not less than two solvents, may be used.

The proportion between the charge generating material and the binder resin in the charge generating layer is preferably 1:5–5:1 in terms of weight ratio. Layer thickness of the charge generating layer is preferably 5 μm or less, and specifically, 0.05–2 μm is more preferable.

The above-mentioned charge transporting material and the binder resin are dissolved in an appropriate solvent, and the charge transporting layer is formed by coating and drying aforesaid solution. Mixture ratio of the charge transporting material and the binder resin is preferably 10:1–1:10 in terms of weight ratio.

Layer thickness of the charge transporting layer is preferably 5–50 μm, and specifically 10–40 μm are preferable.

When the photoreceptor is a single layer type, by coating a solution wherein the charge generating material and the charge transporting material are dispersed in the binder resin dissolved and dried, thus, the single layer type photoreceptor is obtained.

One embodiment of manufacturing method of a cylindrical tube-shaped subtrate for an image forming apparatus will now be explained practically, referring to FIG. 5(*a*).

Figure 5:
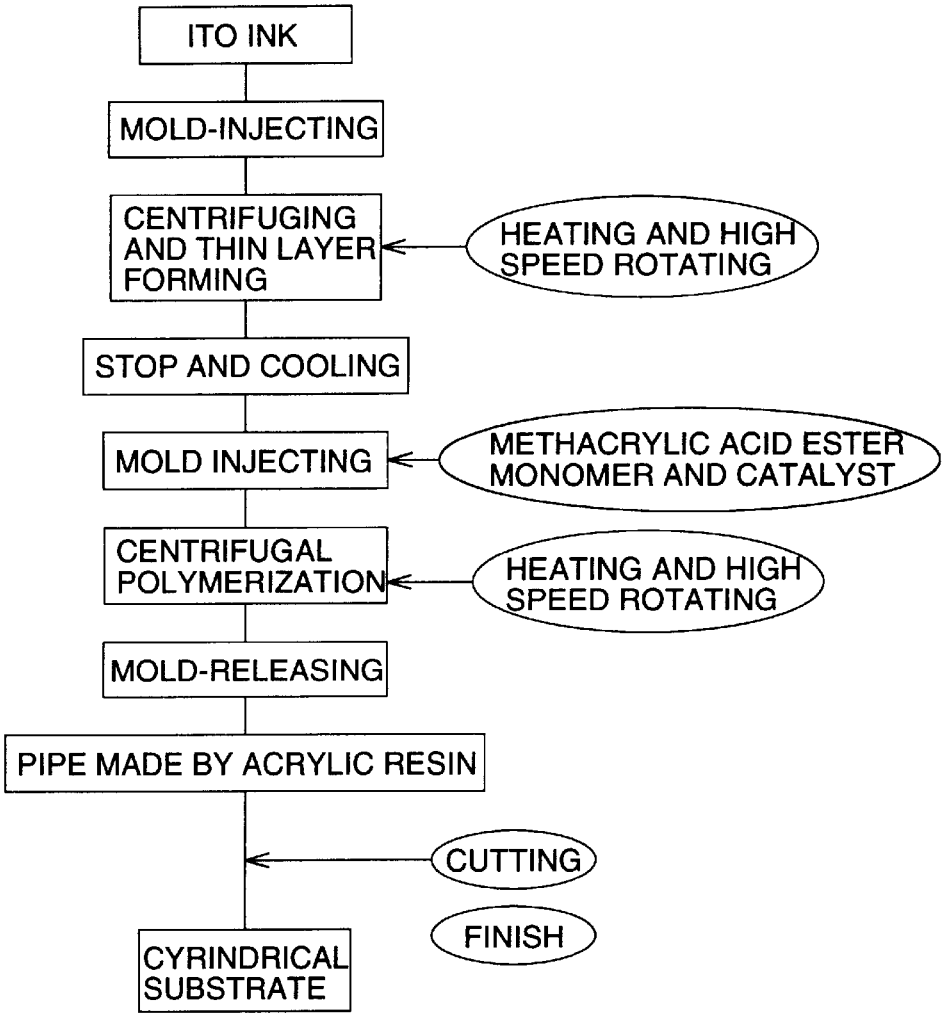
FIG. 5(*a*) is a flow chart of a photoreceptor manufacturing process according to the instant invention.
Figure 5:
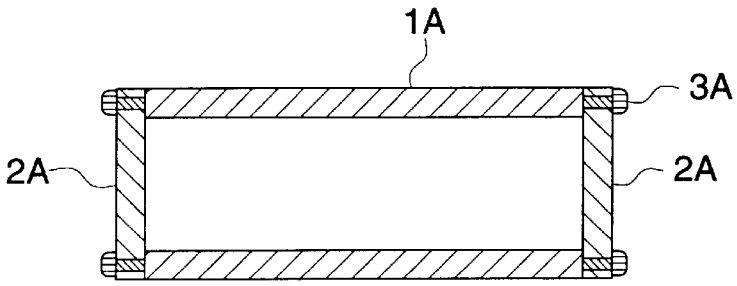

In a manufacturing process shown in FIG. 5, a liquid ink (for example, an ITO ink) wherein conductive fine particles were dispersed in resins was injected in a cylindrical mold. Concurrently with rotating the mold, the mold is heated appropriately so that a uniform conductive layer having a low resistance value is formed. Following this, a methacrylic acid ester monomer wherein a catalyst for accelerating polymerization was added was injected into a mold, and then aforesaid monomer was rotated again. In addition, due to appropriately heating it, uniform polymerization is accelerated. After polymerization is finished, the resulting subtrate is taken up from the mold, and then, cut and finish as necessary. Through them, a cylindrical type subtrate for an image forming apparatus is completed. FIG. 5(*b*) shows a cross sectional view of an example of the mold, wherein a monomer solution is injected in cylindrical mold 1A and lid 2A is provided. Numeral 3A is a bolt and nut for tightening both.

A method of forming a transparent conductive layer of the present invention is a layer formation by a conductive ink wherein fine particles of metal or a metal oxidized product such as aluminum metal, conductive alumna and ITO and a resin are mixed. The volume average particle size of aforesaid fine particle is preferably 0.001–2 $\mu$m.

The surface resistivity value of the coated layer of the present invention may be varied. However, when used as a photoreceptor subtrate, it is preferably of not more than $10^8$ Ω/square. In addition, from viewpoint that it is easy to be manufactured, more preferably of not less than $10^2$ Ω/square. With regard to light transmission rate, in order not to deteriorate sensitivity of photoreceptor, it is preferable to be not less than 50% at the light wavelength of 500–800 nm. With regard to the transmission rate, the higher, the better. However, from viewpoint of the above-mentioned resistivity value of the surface of coating, about 90% is ordinary employed. The thickness of conductive layer is preferably 0.05–1 $\mu$m.

In the present invention, the resistivity value is defined to be surface resistivity. Since the surface resistivity changes depending upon the shape (such as thickness and area) . Therefore, in the field of a sheet material and a semiconductor, the surface resistivity is measured by JIS K-6911. Measurement conditions were as follows.

Environment: 23° C. and 50% RH

Measuring instrument: Loresta AP (MCP-T400) produced by Mitsubishi Yuka Co., Ltd.

The thickness of the cylindrical subtrate in a case where it does not include the thickness of the conductive layer is preferably not less than 1 mm and not more than 5 mm.

Compared with an extrusion method which is a conventional method widely used, the above-mentioned forms an extremely smooth inner surface like glass wherein dies scratch is not formed on the surface of a cylindrical subtrate and, specifically, the inner surface is naturally obtained by centrifugal force. Further, the strength is greater compared with the cylindrical subtrate obtained by the extrusion method, and the above-mentioned method is excellent in terms of stable mechanical strength having no directionality and the heat deformation temperature. Since its inner stress is small, there is no ununiform optical detraction when light is transmitted. If it is used for a cylindrical subtrate for electrostatic latent image forming material (photoreceptor) and is applied to an image forming apparatus wherein an image exposure light source is mounted inside in the cylindrical substrate, image exposure is not distorted, not causing deterioration of image performance.

In FIG. 5, a methacylic acid ester monomer was explained as a polymerizable liquid material. Specifically, any method can be employed provided that heating polymerization and/or light polymerization of the present invention is applicable such as independent use of methyl methacrylate, ethyl methacrylate, butyl methacrylate, ethyl acrylate, butyl acrylate, styrene, each imide, each ester or vinyl chloride or mixture thereof.

By the use of the above-mentioned polymerizable liquid materials, with regard to the transmission rate of the subtrate only, a cylindrical subtrate wherein its light transmission rate reaches to 80–98% at the light wavelength of 500–800 nm can be manufactured. Incidentally, when light is irradiated in polymerizing, it is specifically effective to use light having higher energy level in the field of ultra violet rays. In addition, as a polymerizable liquid material, the above-mentioned each kind of monomer and liquid materials wherein the above-mentioned monomer is polymerized to a certain extent, is used. In order to change them to a light-hardenable type monomer or a resin, as an light polymerization initiator, for example, benzoine-containing compounds (benzoines, benzils or benzoine ethers such as methyl, ethyl, isopropyl and n-butyl), diphenyl, disulfide or organic peroxides may be added.

The surface of the cylindrical subtrate of the present invention is smooth. Specifically, in the case of a polymer of methacrylic acid ester, transparency is extremely excellent and strength is also high. Accordingly, It is suitable for an image forming apparatus wherein an exposure unit is located inside the subtrate drum so that exposure is conducted from inside.

Typically, an electrophotographic photoreceptor wherein a conductive layer and a photoconductive-material photosensitive layer are provided on the surface of the cylindrical subtrate. In order to provide a photosensitive layer, conventional methods may be widely utilized.

Figure 6:
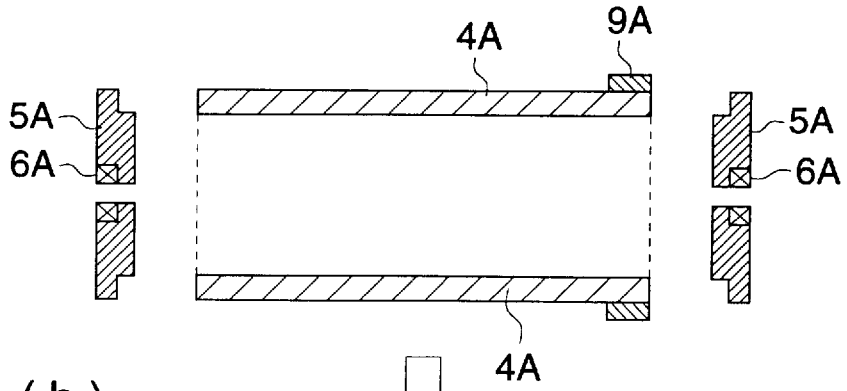
FIGS. 6(*a*), 6(*b*), 6(*c*), and 6(*d*) are views of processes where a gear section is integrally molded according to the instant invention.
Figure 6:
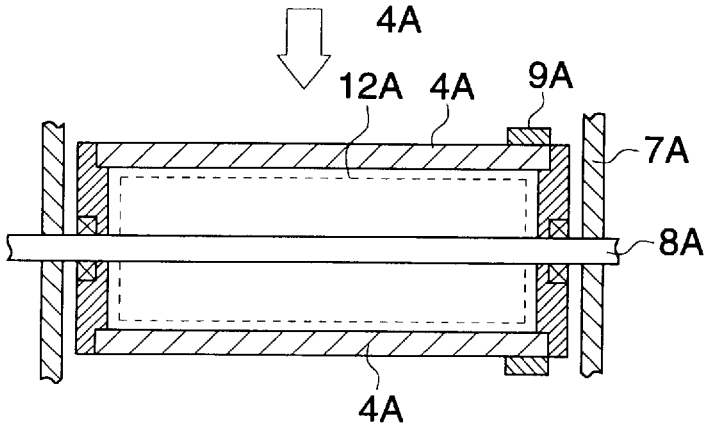
Figure 6:
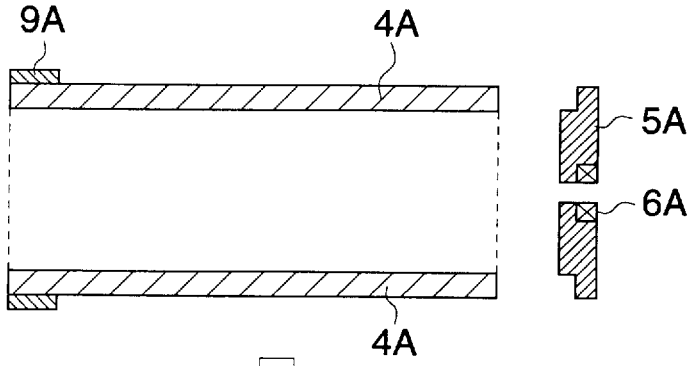
Figure 6:
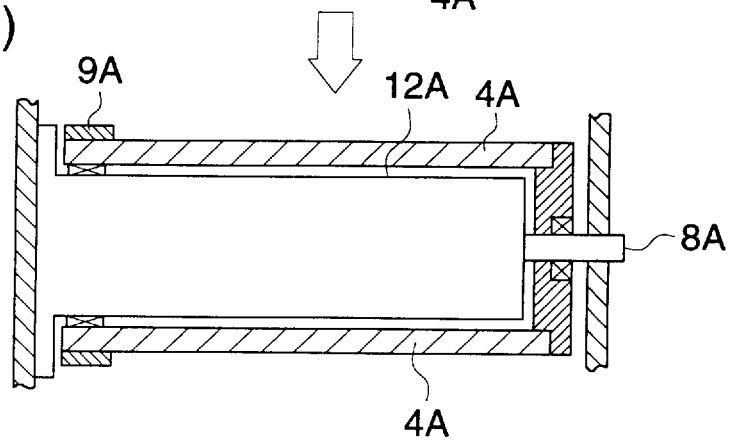

In addition, as shown in FIGS. 6(*a*) and (*c*), by integrally molding a member for gear section 9A for driving on a mold 4A for cylindrical subtrate, they may be manufactured simultaneously when molding for subtrate is processes without mounting the above-mentioned members in a later process. After coating the photosensitive layer on this subtrate, flange 5A Is poured with pressure. FIG. 6(*b*) shows a status wherein aforesaid flange 5A is attached to the apparatus through shaft 8A. Here, numeral 6A is a bearing member, and numeral 7A shows a side wall plate of a box of the image forming apparatus main body.

Figure 7:
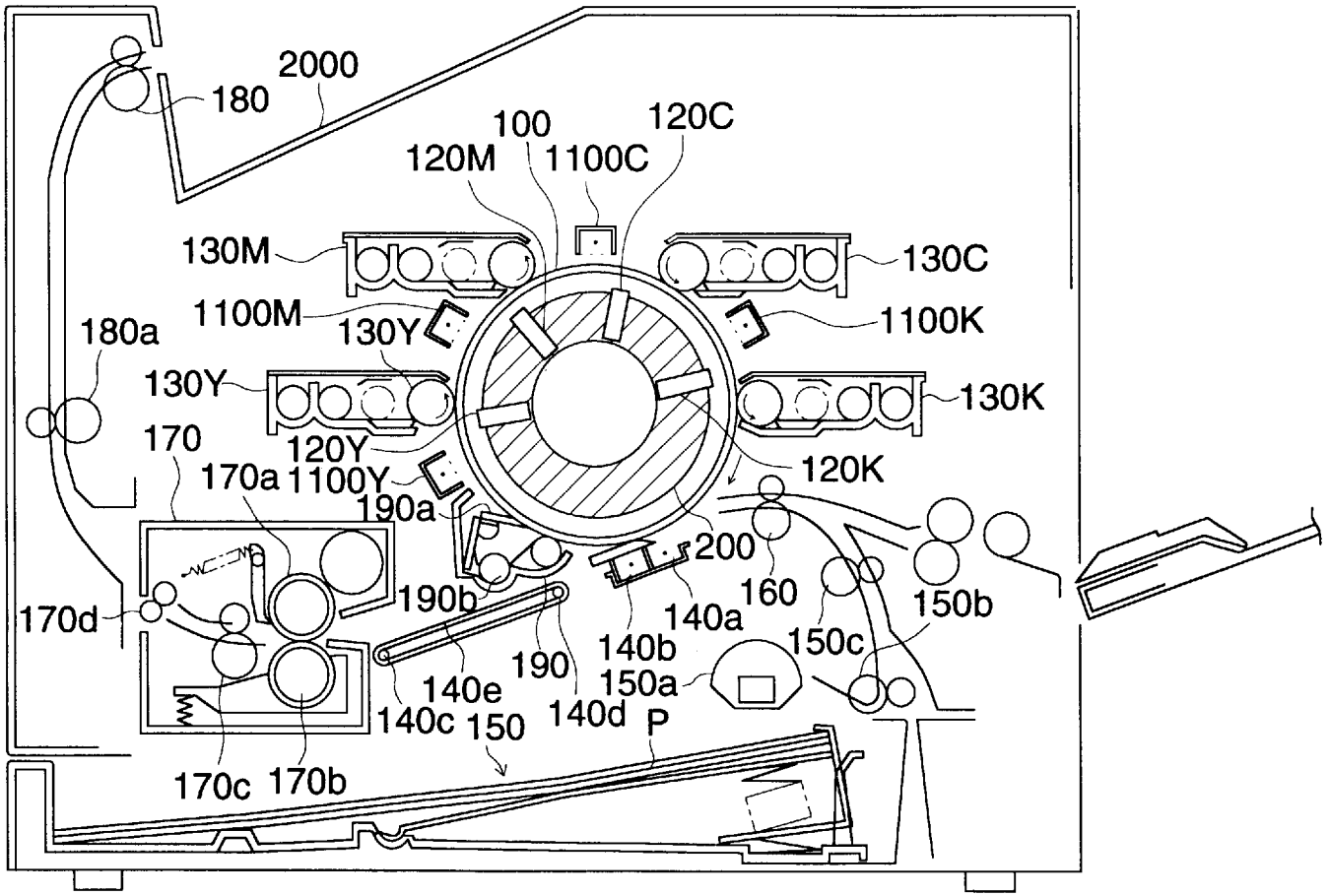
FIG. 7 is a color image forming apparatus using a photoreceptor according to the instant invention.

Incidentally, cylindrical subtrate 4A represents a photoreceptor subtrate having exposure optical system 120 inside thereof as shown in FIG. 7.

In FIG. 6(*c*), flange 5A is located only on the right side. On the left side, gear 9A for driving is integralized. FIG. 6*d*) shows a situation where flange 5A and gear 9A is attached inside the apparatus, and constituted of that exposure optical system 120 is fixed on side wall plate 7A, and cylindrical subtrate 4A is supported by exposure optical system 12A.

The above-mentioned processing method can be, off course, applied to a case when a cylindrical subtrate of the present invention is used as a transfer material or a subtrate for the intermediate transfer material drum.

Figure 2:
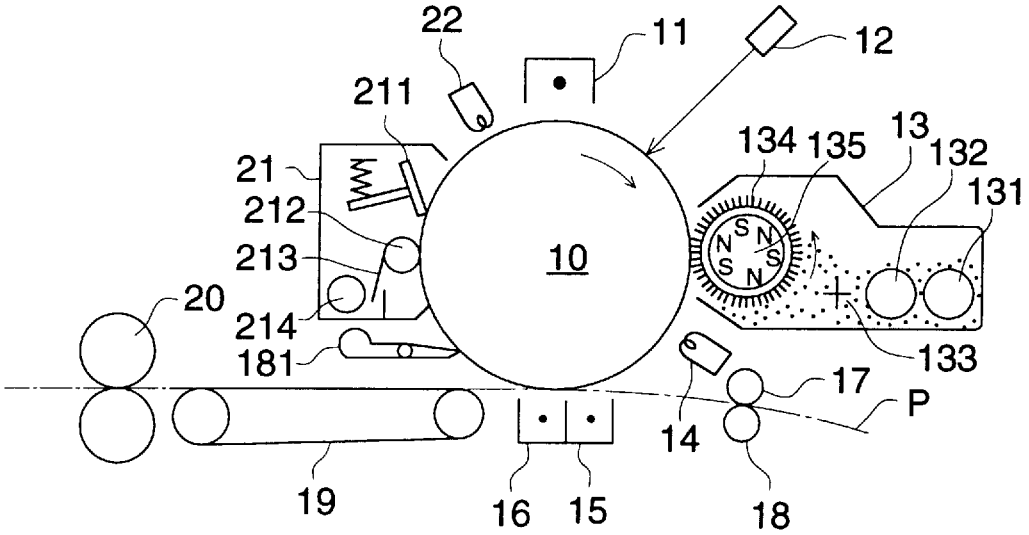
FIG. 2 is a schematic cross sectional view of an image forming apparatus of the present invention.

Hereinafter, the image forming method of the present invention will be explained referring to an analogue type image forming apparatus as shown in FIG. 2. The image forming method of the present invention is not limited thereto. The present invention is applicable to ordinary electrophotographic apparatus such as a digital copying machine, an LED printer and a liquid crystal shutter printer. Further, it can be applied to a recording, printing and facsimile wherein the electrophotographic technology is applied.

In FIG. 2, numeral 10 represents an organic photoreceptor drum, and is driven to be rotated in an arrowed direction. Uniform charging is provided from electrification device 11 to photoreceptor drum 10. By means of an analogue type exposure means 12, image exposure is provided so that electrostatic latent image is formed.

In the above-mentioned image exposure means 12, an image obtained by optically scanning an original by means of an original scanning optical system not illustrated is formed on the above-mentioned photoreceptor drum 10 for forming the above-mentioned electrostatic latent image.

The above-mentioned electrostatic latent image is subjected to magnetic brush developing by means of developer 13 for forming the toner image. Here, developers 13 are filled with a one-component developer composed of a magnetic toner or a two-component developer composed of a nonmagnetic toner and a magnetic carrier. After aforesaid developer is stirred by screws 131 and 132 and stirring fan 133. Following this, aforesaid developers is adhered on sleeve 134 which rotates in an arrowed direction on the circumference of magnetic material 135 for forming a magnetic brush. By means of aforesaid magnetic brush, the above-mentioned electromagnetic latent image is developed.

After the above-mentioned toner image is caused to be easy to be transferred by means of pre-transfer exposure device PTL 14, aforesaid toner image is transferred on recording medium P which has been conveyed in synchronizing with by means of timing roller 17 and 18 due to the effect of transfer pole (transfer device) 15, and then be separated by separation pole (separator) 16.

The above-mentioned separation pole 16 and recording medium P separated by separation claw 181 is conveyed to fixing device 20 by means of transfer belt 19 so that the toner image is heat-fixed onto recording medium P. Photoreceptor drum 10 after the transfer is subjected to cleaning by means of cleaning device (cleaner) 21. The photoreceptor drum is discharged by means of pre-charging charge eliminating lamp PCL 22, and is ready for the next image formation.

In the above-mentioned cleaning device 21, transfer residual toner on photoreceptor drum 10 is cleaned by guide roller 212 and cleaning blade 211. Concurrently with this, the cleaned toner is sent to screw 214 for conveyance through the above-mentioned guide roller 212 and guide plate 213, and then is conveyed to an external toner receiver.

Figure 3:
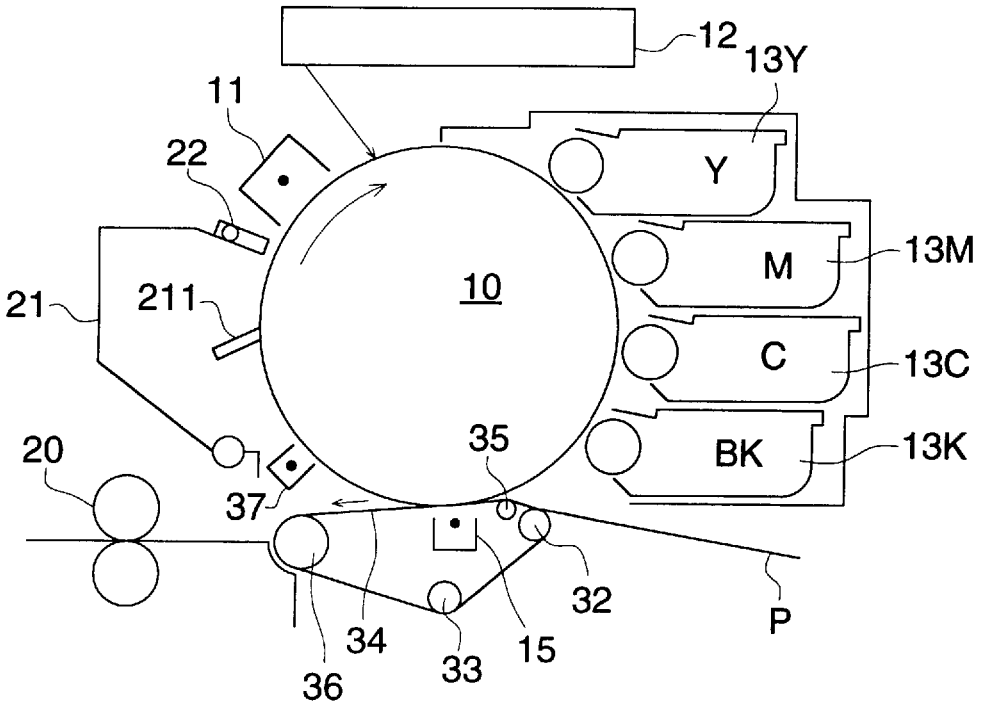
FIG. 3 is a schematic cross sectional view of another image forming apparatus of the present invention.

FIG. 3 is a case of a digital image forming apparatus using a laser image exposure light source. Numeral 10 is an organic photoreceptor drum, which is rotated and driven in an arrowed direction (clockwise direction). The photoreceptor drum is subjected to uniform charge by means of electrification device 11. The photoreceptor drum is further subjected to image exposure by means of image exposure means 12 so that electrostatic latent image is formed. The above-mentioned image exposure means modulates a laser beam from the laser light source, by means of an external image signal. The resulting modulated laser beam scans the photoreceptor by means of a polygonal mirror (not illustrated) which rotates at high speed, so that the electrostatic latent image is formed.

In an image forming apparatus shown in FIG. 3, image exposure by means of a laser beam which has been modulated by the first image signal (a yellow (Y) image signal) in the first rotation of photoreceptor drum 10 so that electrostatic latent image is formed on the above-mentioned drum 10. Aforesaid latent image is developed by developer device 13Y wherein a Y developer containing a Y toner is filled so that the Y toner image is formed.

Next, image exposure by means of a laser beam which has been modulated by the second image signal (a magenta (M) image signal) in the second rotation of photoreceptor drum 10 so that electrostatic latent image is formed on the above-mentioned drum 10. Aforesaid latent image is developed by developer device 13M wherein a M developer containing a M toner is filled so that the M toner image is superposed on the Y toner image on the photoreceptor surface.

Hereinafter, in the same manner as in above, image exposure by means of a laser beam which has been modulated by the third and fourth image signal (a cyan (C) image signal and a black (K) image signal) respectively in the third and fourth rotation of photoreceptor drum 10 so that electrostatic latent image is formed on the above-mentioned drum 10. Aforesaid latent image is developed by developer devices C and K wherein a C and K developers containing a C and K toner are respectively filled so that the C and K toner image is superposed on the above-mentioned Y and M toner image on the photoreceptor surface.

The color toner image composed of 4 color toner image on the above-mentioned drum 10 obtained in the above-mentioned manner is transferred onto recording medium P fed from a paper feeding device (not illustrated) due to the effect by transfer pole (transferrer) 15. Recording medium P on which the color toner image is transferred is adsorbed by the above-mentioned belt 34, conveyed and separated, and then fixed by fixing device 20 so that color image formation is completed.

Recording medium P on which the toner image is transferred is successively conveyed while it is electrostatically adsorbed to the above-mentioned belt 34. Accordingly, the above-mentioned recording medium is separated while it is not adhered on the above-mentioned drum 10. Incidentally, the above-mentioned belt 34 is crossed over through driving belt 36 and guide rollers 32, 33 and 35, and is rotated in the arrowed direction. To the above-mentioned guide roller 32, plus bias voltage is imprinted.

After photoreceptor drum 10 is discharged by charge eliminating device 37 after transferring, it is cleaned by cleaning blade 211 of cleaning device 21. For example, it is neutralized by LED charge eliminating lamp (PCL) 22, and then, ready for the next image formation.

In the above-mentioned image forming apparatus, either of one-component developer or a two-component developer may be used for developers 13Y, 13M, 13C and 13K. Preferably, the two-component developer composed of each of Y, M, C and K toner and a carrier may be used. Electrostatic latent image formed on the above-mentioned drum 10 may either be contact type or a non-contact type, and either of a regular development or a reversal development may be used. Preferably, in order to prevent deterioration the color toner formed previously in advance on the above-mentioned drum 10 by development afterward, a non-contact development method and a reversal development method are used.

As a separation method of a recording medium by means of the above-mentioned belt 34, any method can be used not limited to the above-mentioned method provided that a transfer and separation belt is used. A belt wherein an insulation layer is provided on its surface as a transfer and separation belt 34 and sufficient charge is provided on its surface as described in Japanese Patent O.P.I. Publication No. 20882/1990 may be adopted for adsorption and conveying, transferring and separating the recording medium.

As described in Japanese Patent O.P.I. Publication No. 68976/1991, a pressure roller wherein a transfer bias is imprinted may be used in place of transfer pole 15.

Incidentally, in order to achieve stable transfer and separation, the volume resistivity of the above-mentioned transfer and separation belt 34 is preferably $10^7$–$10^{11}$ Ω/square regardless of the environmental atmosphere.

An embodiment of the image forming apparatus using a photoreceptor wherein insulating and transparent cylindrical subtrate is mounted, will be explained by referring to a color image forming apparatus shown in FIG. 7.

Numeral 100 is a photoreceptor, which is an electrostatic latent image forming material. Hereinafter, manufacturing example thereof will be shown.

1. Manufacturing of a cylindrical subtrate

A transparent conductive paint wherein ink (manufactured by Sumitomo Metal Mining Co., Ltd.) in which ITO fine particle powder and the acrylic resin were mixed was dissolved to 30 wt/vol % with toluene, was injected in a cylindrical mold having an inner diameter of 80 mm and length of 800 mm. By rotating the mold, the entire mold was subjected to heating by vapor for 2 hours at 80° C. while the mold is rotated and is brought into contact with the inner wall of the mold by means of centrifugal force so that a conductive layer whose thickness was 0.2 μm and whose surface resistance was about 5 kΩ/square was manufactured in the inner wall of the mold. As a catalyst for accelerating polymerization, azobisisobutylonitrile was added to methyl methacrylate monomer. Due to preliminary polymerization wherein the resulting material was heated for one hour at 40° C., a syrup type polymerizable liquid material having viscosity of 100 cp was obtained. Aforesaid polymerizable liquid material was injected in the above-mentioned mold. By using vapor, the entire mold was heated for 9 hours at 70° C. for polymerizing. The resulting subtrate was subjected to annealing processing wherein the temperature thereof was chilled to room temperature at 0.2° C./min., and then it was taken up. The ends of the resulting subtrate was subjected to cutting processing so that two cylindrical subtrate having conductivity on the surface having the outer diameter of 80 mm and the length of 360 mm were obtained.

2. Coating of a photosensitive layer

| <Subbing layer> | |
|---|---|
| Titanium chelate compound TC-750 (produced by Matsumoto Seiyaku Co., Ltd.) | 20 parts by weight |
| Silan coupling agent KBM-503 (produced by Shinetsu Chemical Co., Ltd.) | 13 parts by weight |
| 2-propanol | 100 parts by weight |

The above-mentioned compounds were mixed for preparing a subbing solution. The above-mentioned transparent conductive subtrate was dipped therein for coating. The resulting material was dried at 100° C. for 90 minutes for obtaining 1.0 μm thickness subbing layer was obtained.

| <Charge generating layer> | |
|---|---|
| Y-shaped titanyl phthalocyanine | 4 parts by weight |
| Silicone resin KR-5240 (produced by Shinetsu Chemical) | 45 parts by weight |
| 2-butanone | 100 parts by weight |

The above-mentioned compounds were mixed and dispersed with a sandmill for 10 hours so that a coating solution for the charge generating layer was obtained. The above-mentioned subbing layer was dipped in this solution for coating on the above-mentioned subbing layer so that 0.25 μm thickness charge generating layer was obtained.

| <Charge transporting layer> | |
|---|---|
| Charge transporting material | 8 parts by weight |
| Bisphenol Z type polycarbonate Z-300 (produced by Mitsubishi Gas Chemical Co., Ltd.) | 12 parts by weight |
| 1,2-dichloroethane | 100 parts by weight |

The above-mentioned compounds were mixed and dissolved so that a coating solution for the charge transporting layer was obtained. The above-mentioned charge generating layer was dipped in aforesaid coating solution for coating. The resulting material was subjected to heating processing for one hour at 90° C. so that a charge transporting layer having 25 μm thickness was obtained.

1100Y, 1100M, 1100C and 1100K are scorotron electrification device for each of yellow (Y), magenta (M), cyan (C) and black (K) image formation process. In order to let the above-mentioned organic photosensitive layer in photoreceptor 100 to maintain charge having a prescribed potential, electrification was provided by corona discharge for providing uniform potential to photoreceptor 100.

120Y, 120M, 120C and 120K are exposure optical systems which are image exposure device constituted integrally of exposure devices such as FL (an emission of fluorescent substance) wherein emitting devices arranged in a shaft direction of photoreceptor 100 was arranged in a array-shaped row, EL (electro-luminescence), PL (plasma discharger), LED (light emitting diode), LISA (light-magnetic effect light shutter array) which arranges devices having light shutter functions in a row, PLZT (transmission piezo electric device shutter array) and an LCS (liquid crystal shutter) and Selfoc lens as an equivalent-magnification image formation element. Image signals of each color read by an image reading device provided separately is successively taken up from the memory so as to be inputted in the above-mentioned exposure systems 120Y, 120M, 120C and 120K as electrical signals. All of the above-mentioned exposure system 120Y, 120M, 120C and 120K are mounted on cylindrical retention members so that they are incorporated inside a subtrate of the above-mentioned photoreceptor 100.

130Y, 130M, 130C and 130K are developing devices, using a non-contact development method, which incorporate each of yellow (Y), magenta (M), cyan (C) and black (K) developers. Each of them are provided with development sleeves 1300Y, 1300M, 1300C and 1300K which rotate in the same direction while each other having a prescribed developing gap with the circumference of photoreceptor 100.

The above-mentioned developers 130Y, 130M, 130C and 130K reversibly develop electrostatic latent image on photoreceptor 100 formed due to charging by corona chargers

1100Y, 1100M, 1100C and 1100K and image exposure by exposure optical systems 120Y, 120M, 120C and 120K in a non-contact status by impressing development bias voltage.

With regard to the original image, in the image reading device provided separately an image read by a photographing devices or an image edited by a computer are temporarily stored in the memory as image signals for each color and then incorporated.

After the start of image recording, due to the start of photoreceptor driving motor, photoreceptor 100 is rotated in clockwise direction, and concurrently with this, potential providing to photoreceptor 100 was started due to electrification effect of corona electrification device 1100Y.

After photoreceptor 100 is provided with potential, in the above-mentioned exposure optical systems, exposure by an electrical signal corresponding to the first color signal, i.e., yellow image signal starts. Due to rotation scanning of the drum, an electrostatic latent image corresponding to yellow (Y) image of the original image is formed on the photosensitive layer on the surface of the drum.

The above-mentioned latent image is reversibly developed by developer 130Y wherein the developer on the development sleeve is in non-contact state. In accordance with the rotation of photoreceptor drum 100, yellow (Y) toner image is formed.

Next, photoreceptor drum 100 is provided with potential on the above-mentioned yellow (Y) toner image due to electrification effect of corona electrification device 1100M. Exposure by means of an electrical signal which corresponds to the second color signal, i.e., magenta (M) image signal is conducted. Due to non-contact reversal development by developing device 130M, the magenta (M) toner image is successively superposed on the above-mentioned yellow (Y) toner image.

According to the same process, a cyan (C) toner image which corresponds to the third color signal is successively superposed on the magenta (M) toner image by means of corona charger 1100C, exposure optical system 120C and developing device 130C is successively superposed to be formed, and then, a black (K) toner image which corresponds to the fourth color signal is successively superposed on the cyan (C) toner image by means of corona electrification device 1100K, exposure optical system 120K and developing device 130K is successively superposed to be formed. Thus, a color toner image is formed on the circumference of the photoreceptor drum within one rotation.

The above-mentioned exposure to an organic photosensitive layer on photoreceptor drum 100 using the above-mentioned exposure optical systems is conducted from inside the transparent subtrate through a transparent subtrate. Accordingly, image exposure corresponding to the second, third and fourth color signal does not receive any influence from the toner image previously formed. The electrostatic latent image having the same characteristics as an image corresponding to the first color signal can be formed. Incidentally, for stabilizing temperature and preventing increase of the temperature inside the photoreceptor drum due to heat of exposure optical systems 120Y, 120M, 120C and 120K, a material having favorable heat conductance was employed for the above-mentioned retention member 200. When temperature is too low, a heater can be used. When it is too high, heat is emitted to outside of the apparatus through a heat pipe. Due to these, temperature can be restricted until it does not give adverse effect. When developing using developing devices 130Y, 130M, 130C and 130K, D.C. development bias is imprinted or D.C. development bias added by A.C. is imprinted. Then, jamping development by one-component developer or two-component developer incorporated in the developing device is conducted. D.C. bias having the same polarity as toner was imprinted to photoreceptor 100 wherein a transparent conductive layer was grounded so that non-contact reversal development wherein the toner is adhered on the exposure section is conducted.

As described above, a color toner image formed on the circumference of the photoreceptor drum is transferred, at transfer device 140, onto recording material P which was fed by feeding roller 150*a* from paper feeding cassette 150, conveyed to the timing roller 160 by paired conveyance rollers 150*b* and 150*c* and fed in synchronizing with the toner image on photoreceptor 100 by the driving of timing roller 160.

From recording material P wherein the toner image was transferred, electrification was removed by a charge eliminating device 140*b*, and then separated from the circumference of the drum. Following this, the recording material was conveyed to fixing device 170 by means of conveyance roller 140*e* crossed over between driving roller 140*c* and driven roller 140*d*. At fixing device 170, the recording material was heated and pressed between fixing roller 170*a* and pressure roller 170*b* so that the toner was fused and fixed onto recording material. By means of paired rollers 170*d* at the outlet of the fixing device 170*d*, the recording material was ejected from fixing device 170. The recording material was conveyed by paired paper ejecting and conveyance rollers 180*a*, and then ejected on paper ejection tray 2000 on the top of the apparatus through paper ejection roller 180. Recording material processed using the above-mentioned photoreceptor subtrate of the present invention was extremely vivid so that remarkable excellent image was obtained.

On the other hand, the surface of photoreceptor 100 wherein the recording material was separated therefrom was scrubbed by cleaning blade 190*a* at cleaning device 190 so that cleaning toner was removed and cleaned. Following this, formation of the toner image of original image is continued or temporarily stops and then start formation of the toner image of a new original image. Waste toner scrubbed by cleaning blade 190*a* is ejected to a waste toner container (not illustrated) by a toner conveyance screw 190*b*.

Since an image obtained by the above-mentioned image forming process was obtained by superposing imaged due to the rotation of photoreceptor drum, image preparation speed is extremely high, and resolution and sharpness are extremely excellent.

The above-mentioned photoreceptor 100 incorporates the exposure optical system therein. Therefore, even if the size of the drum is relatively small, plural of the above-mentioned corona electrification devices 1100Y, 1100M, 1100C and 1100K, developing devices 130Y, 130M, 130C and 130K can be included therein. Accordingly, by the use of a small-sized drum whose outer diameter is 30–150 mm, volume of the apparatus can be downsized.

EXAMPLE

Hereinafter, the present invention will be explained in detail referring to examples. However, the embodiment of the present invention is not limited thereto. [1] Measurement of the work function W of the conductive layer and ionization potential in the intermediate layer Ip Manufacturing samples of conductive layers

| No. | Conductive substance | Drying conditions |
|---|---|---|
| 1 | Kolcoat 2002 ($SnO_2$) produced by Kolcoat | 80° C. and 30 min. |
| 2 | Kolcoat 2002 ($SnO_2$) produced by Kolcoat | 25° C. and 30 min. |
| 3 | ST poly (polypyrrole) produced by Achille's | 80° C. and 30 min. |
| 4 | X-101H(ITO) produced by Sumitomo Metal Mining Co., Ltd. | 80° C. and 30 min. |
| 5 | Aluminum deposition | |

In Nos. 1–4, a coating solution wherein a conductive material was dispersed in a resin was coated on a PET base. In No. 5, the conductive material was deposited on the PET base so that the conductive layer was formed.

Manufacturing samples of intermediate layers No. 1

A mixed solution of

| | |
|---|---|
| Titanium chelate compound TC-750 (produced by Matsumoto Seiyaku Co., Ltd.) | 20 parts by weight |
| Silane coupling agent KBM-503 (produced by ShinEtsu Chemical Co., ltd.) | 13 parts by weight |
| Toluene | 100 parts by weight |

was coated on a PET base. Following this, the resulting material was dried for 30 minutes at 120° C.

No. 2

A mixed solution of

| | |
|---|---|
| Alamine CM8000 (copolymer nylon, produced by Toray) | 10 g |
| Methanol | 2400 ml |
| Buthanol | 600 ml |

was coated on a PET base. Following this, the resulting material was dried for 30 minutes at 120° C.

Incidentally, the thickness of samples for measuring work function W(eV) of conductive layer Nos. 1–5 and samples for measuring Ionization potential Ip(eV) of intermediate layer Nos. 1–2 were 1.0 $\mu$m.

(Measurement method and their results)

Using a low energy electron spectrometer (Model AC-1) produced by Riken Keiki Co., Ltd.), work function W of the conductive layer and Ionization potential Ip of the intermediate layer were measured.

| Work function of the conductive layer | |
|---|---|
| No. 1 | 5.11 eV |
| 2 | 5.02 eV |
| 3 | 4.91 eV |
| 4 | 4.71 eV |
| 5 | 3.90 eV |
| **Ionization potential Ip of the intermediate layer** | |
| No. 1 | 5.55 eV |
| 2 | 5.48 eV |

[2] Evaluation on potential properties conditions

On a PET base, the above-mentioned conductive layers Nos. 1–5 were formed. On each layer, intermediate layers Nos. 1 and 2 were formed. On the above, a charge generating layer and a charge transporting layer having the following composition respectively were coated. Next, on the drum used in modified 9028 machine, a belt-shaped photosensitive material was wound.

| | |
|---|---|
| (Charge generating layer) | |
| Y-shaped titanyl phthalocyanine (G-1) | 4 parts by weight |
| Silicone resin KR-5240 (produced by Shinetsu Chemical) | 45 parts by weight |
| 2-butanol | 100 parts by weight |
| (Charge transporting layer) | |
| Charge transporting material (T-1) | 8 parts by weight |
| Bisphenol Z type polycarbonate Z-300 (produced by Mitsubishi Gas Chemical Co., Ltd.) | 12 parts by weight |
| 1,2-dichloroethane | 100 parts by weight |

The above-mentioned compounds were mixed and dissolved, so that a coating solution for the charge transporting layer was obtained. The above-mentioned charge generating layer was dipped in this coating solution and subjected to heat processing for 1 hours at 95° C. so that a 25 $\mu$m-thickness charge transporting layer was formed.

G-1 structure

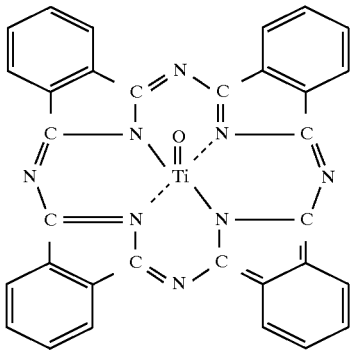

T-1 structure

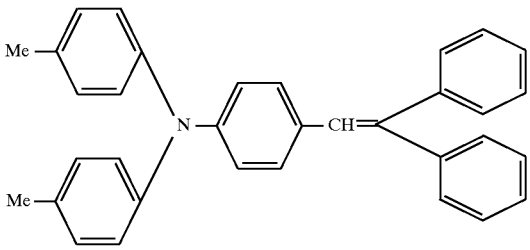

[Evaluation method and results]

Each of the above-mentioned sample was loaded on an modified machine of Konica 9028 produced by Konica Corporation. Table 1 shows the evaluation results evaluated by the following method.

TABLE 1

| Sample No. | Conductive layer No. | Intermediate layer No. | Ip-W (eV) | Electrification potential (−V) | Dark decay rate (%) | Fogging (visual check) | Remarks |
|---|---|---|---|---|---|---|---|
| a | 1 | 1 | 0.44 | 1020 | 36 | C | Comparative |
| b | 2 | 1 | 0.53 | 1237 | 15 | A | Inventive |

TABLE 1-continued

| Sample No. | Conductive layer No. | Intermediate layer No. | Ip-W (eV) | Electrification potential (−V) | Dark decay rate (%) | Fogging (visual check) | Remarks |
|---|---|---|---|---|---|---|---|
| c | 3 | 1 | 0.64 | 1375 | 11 | A | Inventive |
| d | 4 | 1 | 0.84 | 1480 | 7 | A | Inventive |
| e | 5 | 1 | 1.66 | 1520 | 4 | A | Inventive |
| f | 1 | 2 | 0.37 | 1050 | 35 | C | Comparative |
| g | 2 | 2 | 0.46 | 1205 | 22 | C | Comparative |
| h | 3 | 2 | 0.57 | 1319 | 15 | A | Inventive |
| i | 4 | 2 | 0.77 | 1352 | 13 | A | Inventive |
| j | 5 | 2 | 1.59 | 1534 | 5 | A | Inventive |

(Electrification potential)

Photoreceptor potential at the position of developing device when the above-mentioned Konica 9028 modified machine was normally operated was measured (by means of a scorotron type corona electrification device. Aforesaid potential corresponds to the electrification potential of the photoreceptor immediately after being charged.)

(Dark decay rate)

Potential after 40 seconds after measuring the above-mentioned electrification potential was measured again, and how is its decrease rate was calculated in terms of percentage.

(Whether or not fogging occurs)

The Konica 9028 modified machine was normally operated so that original composed of unexposed portions, monochrome portions and color portions was continuously copied for 40,000 copies. The condition of the occurrence of fogging was visually evaluated from the beggining to the 40,000 copies. Incidentally, the copying test was conducted under the conditions of 20° C. and 60% RH.

A: No fogging appeared up to 40,000th copy.

B: At the point of 40,000th copies, fogging occurred slightly

C: Initially, no fogging occurred. However, on and after 10,000th copy, fogging occurred.

Figure 4:
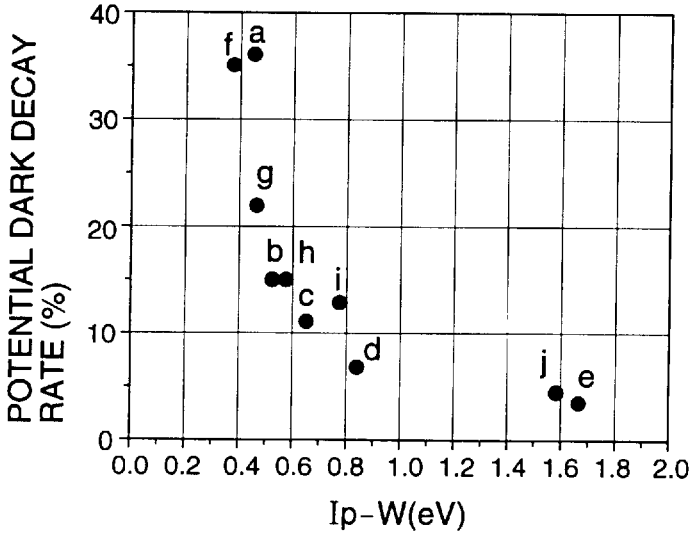
FIG. 4 shows the relationship between dark decay rate and "(Ionized potential in the intermediate layer Ip—work function of the conductive layer W)".

In addition, FIG. 4 shows the relationship between dark decay rate and "(Ionization potential in the intermediate layer Ip—work function of the conductive layer W)".

As is apparent from the results of FIGS. 1 and 4, samples b–e and samples h–j of the present invention provide excellent results in electrification potential, dark decay rate and fogging property, while samples a, f and g which are out of the present invention have some problems in either of aforesaid properties.

What is claimed is:

1. An electrophotographic photoreceptor comprising a cylindrical insulating support and provided thereon, a conductive layer, an intermediate layer, and a photosensitive layer, wherein said conductive layer has a work function W (eV), said intermediate layer has an ionization potential Ip (eV) and a relationship between the work function W (eV) and the ionization potential Ip (eV) satisfies Formula 1:

$$Ip>W+0.5, \qquad \text{Formula 1}$$

wherein said insulating support is a cylindrical insulating support, said insulating support and said conductive layer are prepared by (1) injecting a conductive ink containing conductive fine particles and a resin into a cylindrical mold, (2) applying heat to the injected conductive ink while rotating the cylindrical mold to form a cylindrical conductive layer on an inside wall of the cylindrical mold, (3) injecting a polymerizable material into the cylindrical mold, whereby said polymerizable material is provided on said cylindrical conductive layer, and (4) applying heat or light to polymerize said polymerizable material while rotating said cylindrical mold to form said cylindrical insulating support on said cylindrical conductive layer.

2. The electrophotographic photoreceptor of claim 1, wherein the relationship between the work function W (eV) and the ionization potential Ip (eV) satisfies Formula 2, provided that said work function W (ev) satisfies Formula 3:

$$7>Ip>W+0.5, \qquad \text{Formula 2}$$

$$3.5<W<6.0. \qquad \text{Formula 3}$$

3. The electrophotographic photoreceptor of claim 1, wherein the relationship satisfies Formula 4:

$$7>Ip>W+0.7. \qquad \text{Formula 4}$$

4. The electrophotographic photoreceptor of claim 1, wherein said insulating support comprises a compound selected from the group of consisting of polyethylene terephthalate resin, polyethylene naphthalate resin, acrylic resin, methacrylic resin, polystyrene resin, polyimide resin, polyvinyl chloride resin and a glass.

5. The electrophotographic photoreceptor of claim 1, wherein said conductive layer contains a compound selected from the group consisting of aluminum, copper, gold, silver, palladium and a metal oxide.

6. The electrophotographic photoreceptor of claim 1, wherein said intermediate layer comprises polyamide resin.

7. The electrophotographic photoreceptor of claim 1, wherein said intermediate layer is prepared by hardening a coating composition containing an organic metal compound or a silane coupling agent.

8. The electrophotographic photoreceptor of claim 1, wherein said conductive layer has a surface resistivity of not more than $10^8$ Ω/square.

9. The electrophotographic photoreceptor of claim 1, wherein said insulating support has a resistivity of not less than $10^{10}$ Ω/square.

10. The electrophotographic photoreceptor of claim 1, wherein said light is ultra-violet rays.

11. The electrophotographic photoreceptor of claim 1, wherein said polymerizable material is transparent.

* * * * *